United States Patent [19]

Kusz et al.

[11] 4,454,955

[45] Jun. 19, 1984

[54] CHILD RESISTANT PACKAGE

[75] Inventors: Maximillian Kusz, Waterville; William E. Fillmore, Toledo, both of Ohio

[73] Assignee: Owens-Illinois, Inc., Toledo, Ohio

[21] Appl. No.: 512,837

[22] Filed: Jul. 11, 1983

[51] Int. Cl.[3] ..... B65D 55/02

[52] U.S. Cl. ..... 215/220

[58] Field of Search ..... 215/219, 220, 251, 256, 215/258

[56] References Cited

U.S. PATENT DOCUMENTS 3,944,102 3/1976 Grau ..... 215/220

4,330,067 5/1982 Deussen ..... 215/220

*Primary Examiner*—George T. Hall

*Attorney, Agent, or Firm*—John R. Nelson; Myron E. Click

[57] ABSTRACT

A child-resistant package comprising a container having an exteriorly threaded finish portion, and a closure comprising an inner cap member having a top panel integrally formed with a depending skirt portion having threads formed on the interior surface thereof for engagement with the finish portion of the container, and an outer member having a peripheral skirt portion surrounding the skirt portion of the inner cap member. Interengaging members between the inner cap member and the outer closure member are operable upon relative axial movement between the members to interengage the members such that rotation of the outer member will also rotate the inner member to disengage the threads of the inner member from the threads of the container. A tamper-indicating member comprising an annular ring has portions extending between the lower edge of the skirt portion of the outer closure member and a portion of the container which are operable to prevent axial movement of the outer closure member relative to the inner closure member.

32 Claims, 13 Drawing Figures

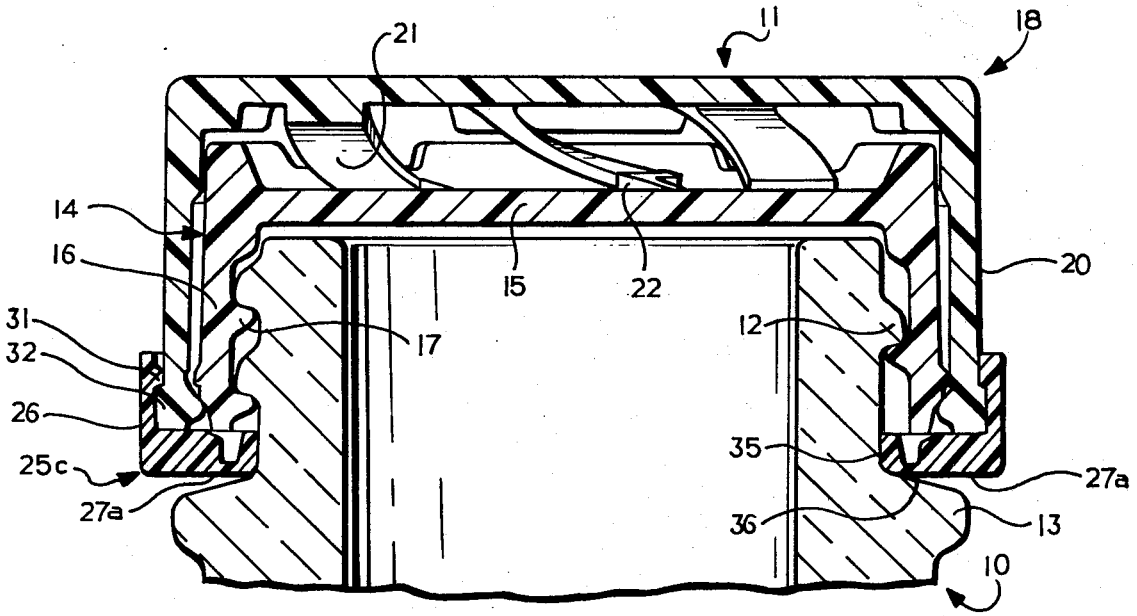
FIG. 9
FIG. 13
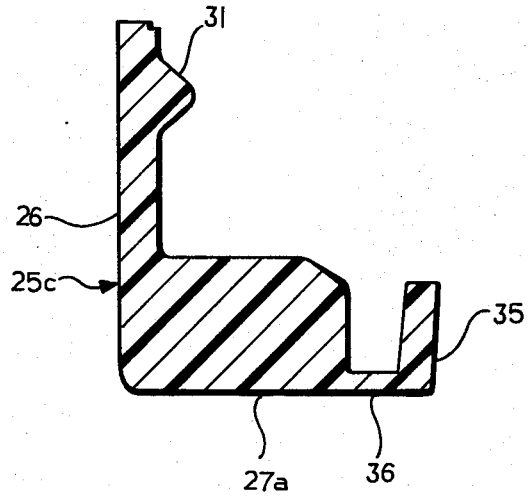

CHILD RESISTANT PACKAGE

This invention relates to child-resistant packages.

BACKGROUND AND SUMMARY OF THE INVENTION

In one type of child-resistant package used for packaging products that may be harmful to children, two-piece closures are provided, one closure member of the closure being adapted to be threaded onto and off the container and the other closure member of the closure being constructed and arranged so that the two parts must be operated in a particular fashion in order to remove the closure rather than merely rotating the member that is grasped. For example, in U.S. Pat. No. 3,857,505, interengaging means are provided between the top panels of inner and outer closure members that are telescoped within one another so that the inner closure member can only be rotated when the outer closure member is moved axially to interengage the inner closure member. In another type of closure, the interengaging means are provided between the skirt portions of the inner and outer closure members and interengaged by relative axial movement between the members.

In connection with such closures, it is common to provide an inner seal over the upper end of the container so that upon removal of the closure, it can be readily ascertained whether the contents have been tampered with. However, the integrity of such a seal cannot be ascertained until the closure is removed.

Accordingly, among the objectives of the present invention are to provide a child-resistant package which includes a tamper-indicating device on the closure which provides a visual indication that the contents are intact and which must be removed before the closure can be actuated and removed from the container.

In accordance with the invention, a tamper-indicating ring is provided that has portions that extend between the lower edge of the skirt portion of the outer closure member and the container to prevent axial movement of the outer closure member. The ring offers a visual indication that the contents have not been tampered with and must be removed before the closure can be removed.

DESCRIPTION OF THE DRAWINGS

FIG. 9 is a fragmentary sectional view of another modified form of the child-resistant package.

FIG. 13 is a sectional view on an enlarged scale taken along the line 13—13 in FIG. 11.

DESCRIPTION

The invention is shown in connection with a two-piece child-resistant closure such as shown in U.S. Pat. No. 3,857,505 which is incorporated herein by reference. However, as will be readily apparent, the invention is also applicable to other types of two-piece closures such as shown in British Patent Specification No. 1,529,999 wherein some type of interengaging means are provided between the two closure members.

Figure 1:
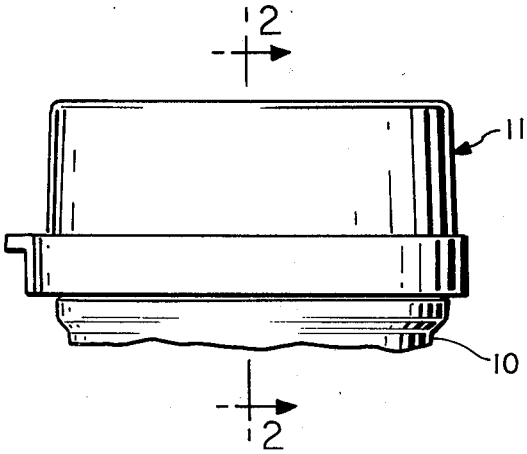
FIG. 1 is an elevational view of a child-resistant package embodying the invention.
Figure 2:
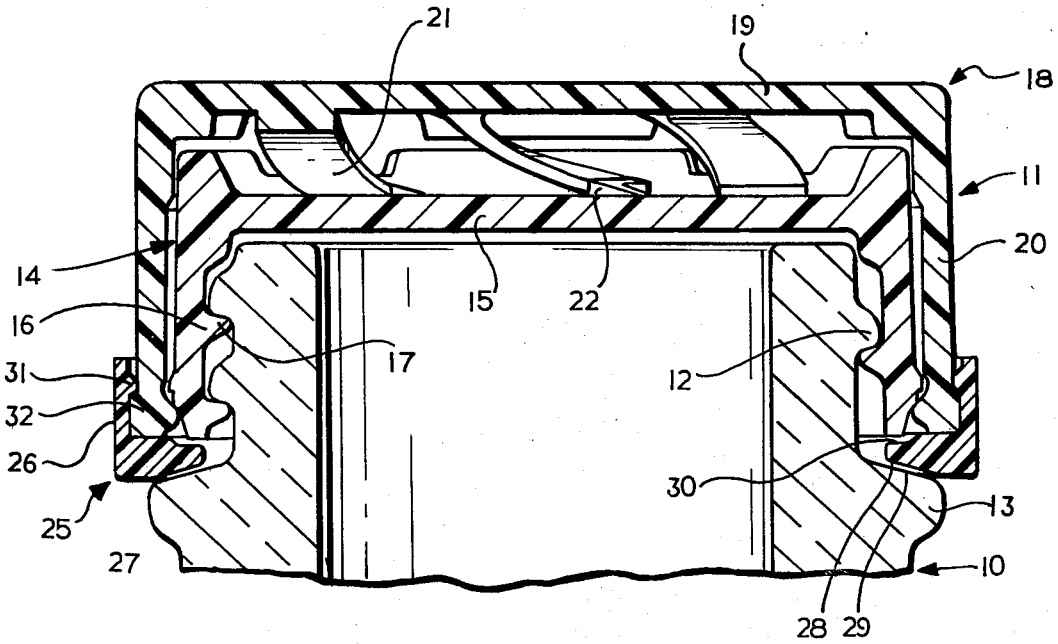
FIG. 2 is a fragmentary sectional view of the child-resistant closure taken along the line 2—2 in FIG. 1.
Figure 3:
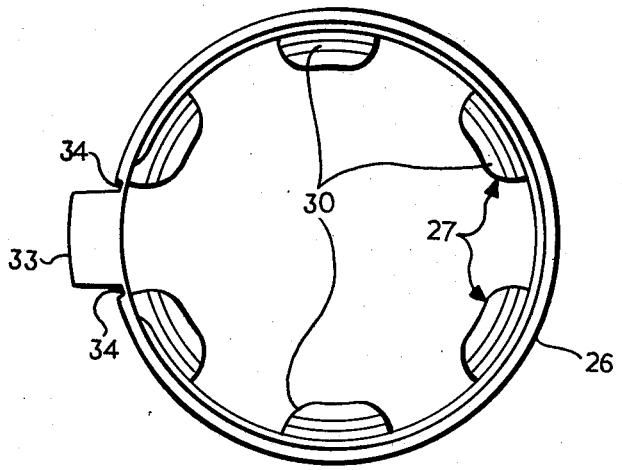
FIG. 3 is a top plan view of the tamper-indicating ring.
Figure 4:
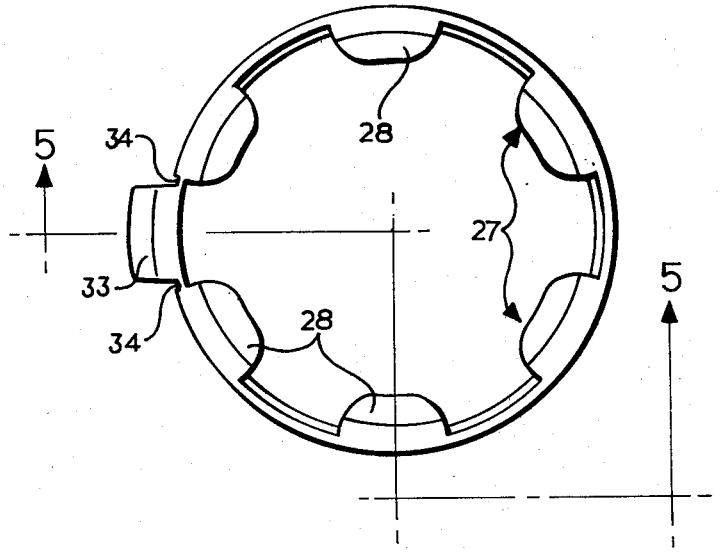
FIG. 4 is a bottom plan view of the tamper-indicating ring.
Figure 5:
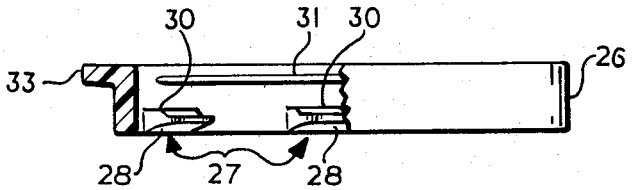
FIG. 5 is a part sectional side elevational view of the ring taken along the line 5—5 in FIG. 4.

Referring to FIGS. 1 and 2, the child-resistant package comprises a container 10 made of glass or plastic such as polystyrene, and a closure 11 preferably made of plastic such as polypropylene. The container has a finish that includes an external thread 12 and an annular bead 13 spaced below threads 12. The closure 11 includes an inner cap member 14 having a top panel 15 and an integral depending skirt portion 16 having threads 17 formed on its interior surface for engagement with the threads 12 on the container. The closure includes an outer closure member 18 having a top panel 19 and an integral depending skirt portion 20. The depending skirt portion 20 of the outer member 18 loosely encompasses the depending skirt 16 of the inner member to allow relative rotary and axial movement between the inner and outer members 14, 18.

Interengaging means are provided on the underside of the top panel 19 of the outer closure member 18 and the upper side of the top panel 15 of the inner cap member 14 which are operable upon relative axial movement between the members to interengage the members such that rotation of the outer member will also rotate the inner member to disengage the threads so that the closure can be removed. Such interengaging means may comprise members 21, 22 such as shown in U.S. Pat. No. 3,857,505 which is incorporated herein by reference.

Referring to FIGS. 2–5, a tamper-indicating member 25, preferably made of plastic such as high density polyethylene, is provided about the lower end of the closure and comprises an annular wall 26 and a plurality of projections 27 extending radially inwardly from the inner surface of the wall 26 between the lower end of the skirt portion 20 of the outer closure member 18 and a bead or shoulder 13 on the container 10. Bead 13 is positioned such that there is sufficient space between the lower end of skirt portion 20 and the bead 13 for the projections 27.

Projections 27 preferably have a lower surface 28 generally complementary to surface 29 of the bead 13 on the container. The upper surface 30 of each projection is planar and spaced from the lower edge of the skirt portion 16 of the inner closure member 14.

Tamper-indicating ring 25 includes arcuate circumferentially extending beads 31 on the inner surface of the wall 26 that snaps over a small flange 32 on the skirt portion of the outer closure member 18 to retain the ring 25 on the closure during handling and application on the container 10. The vertical distance between beads 31 and the projections 27 is substantially equal to the height of the flange 32 so that the ring 25 is held tightly on the closure.

When the two members 14, 18 have been assembled and ring 25 is positioned on the closure 11, the closure is threaded onto the container, the ring 25 is positioned so that projections 27 extend between the outer closure member 18 and the bead 13 on the container. Any effort to move the outer closure member 18 axially to engage the inner closure member 14 is prevented by the projections 27. Accordingly, the tamper-indicating ring 25 provides a visual indication that the package has not been tampered with.

Figure 6:
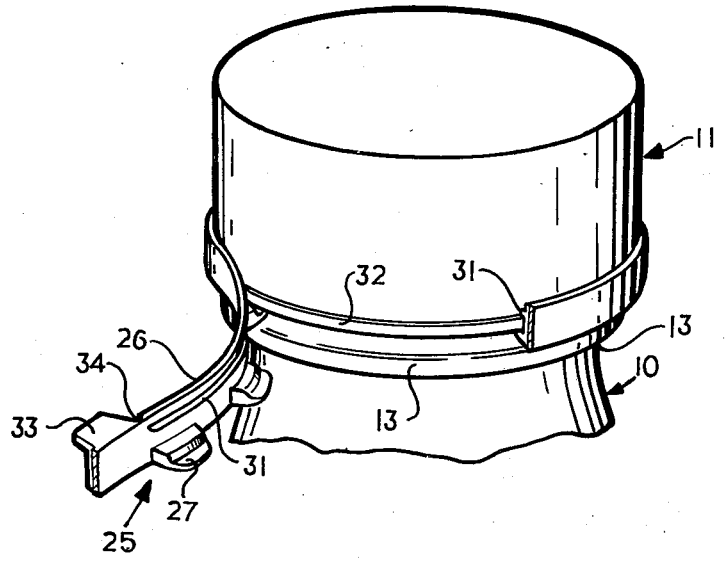
FIG. 6 is a fragmentary perspective view of the child-resistant package during opening of the package.

In order to remove the closure, the tamper-indicating ring 25 must first be removed. To facilitate this, a radial tab 33 is provided which is grasped to tear the band. (FIG. 6) To further facilitate the tearing, axial grooves 34 on the band define weakened lines.

Figure 7:
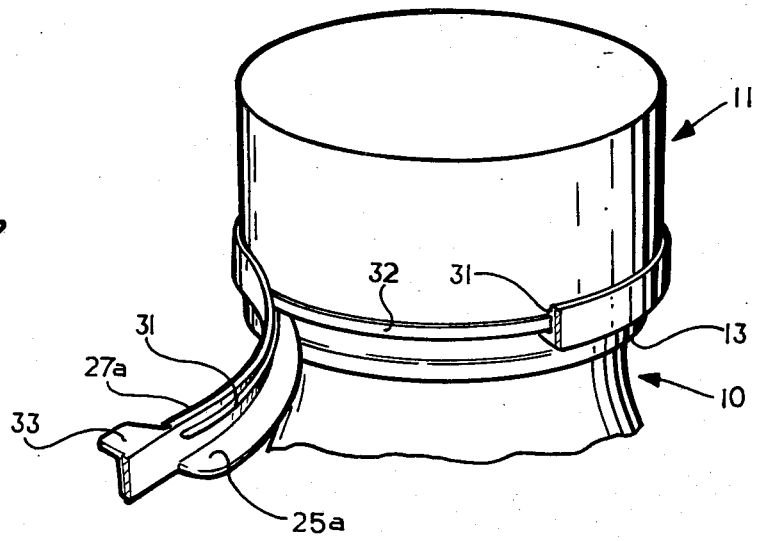
FIG. 7 is a fragmentary perspective view of a modified form of child-resistant package.

In the form of the invention shown in FIG. 7, the portion of the tamper-indicating band **25*a* which projects between the closure and the bead 13 on the container comprises a continuous annular ring 27*a*** extending radially inwardly.

Figure 8:
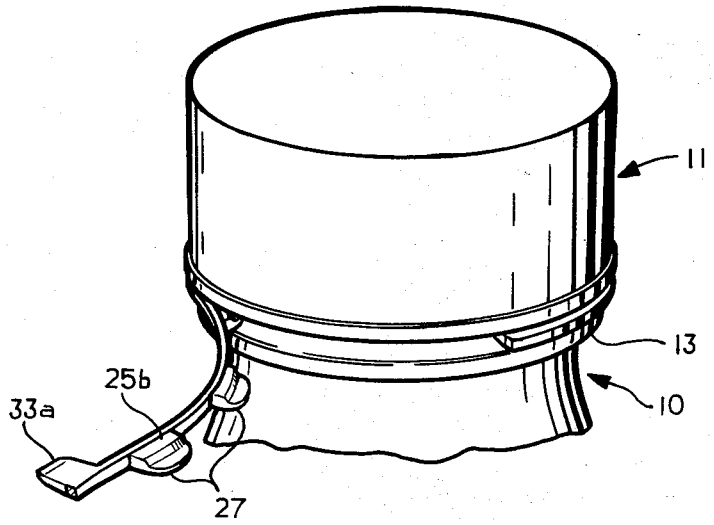
FIG. 8 is a fragmentary perspective view of another modified form of child-resistant package.
Figure 10:
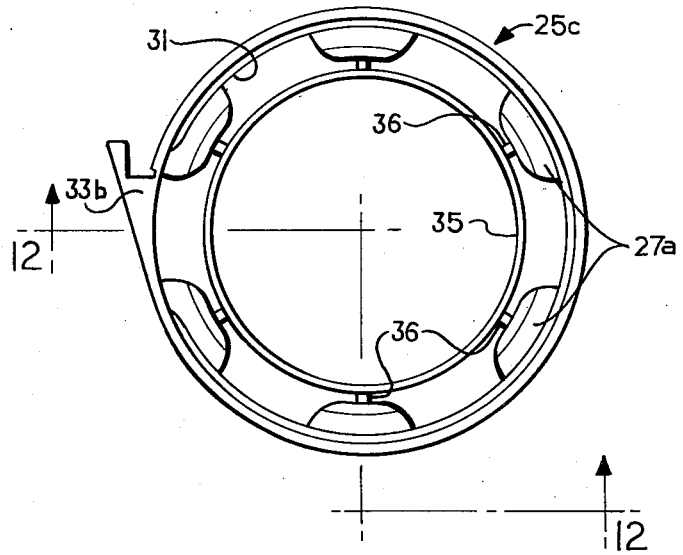
FIG. 10 is a top plan view of the tamper-indicating ring utilized in the child-resistant package shown in FIG. 9.
Figure 11:
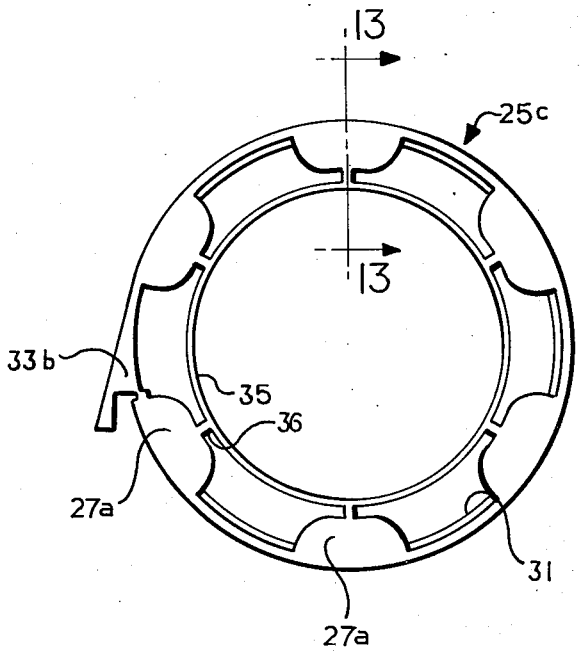
FIG. 11 is a bottom plan view of the tamper-indicating ring shown in FIG. 10.
Figure 12:
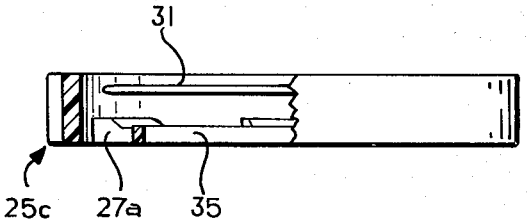
FIG. 12 is a sectional view taken along the line 12—12 in FIG. 10.

In the form of the invention shown in FIG. 8, the tamper-indicating member **25*b* comprises a ring and is formed without an annular wall. The projections 27 and tab 33*a*** extend from the ring. This form of tamper-indicating member must be placed on the container before the closure is applied to the container.

In the form of the invention shown in FIGS. 9–13, the tamper-resistant ring **25*c* includes a tangential tab 33*b* which is grasped to tear the ring 25*c* along a weakened line 34*a*. The ring 25*c* further includes a small inner ring 35 connected to projections 27*a* by bridge portions 36 that are torn when the ring 25*c* is removed thereby giving a visual indication that the tamperproof ring 25*c* has been removed. Ring 35 can also be used with the tamper-indicating rings 25, 25*a* and 25*b* shown in FIGS. 2–8**.

It can thus be seen that there has been provided a tamper-indicating device which will effectively present opening of tthe package and must first be removed. The presence of the tamper-indicating device provides visual indication that the child resistant package has not been tampered with.

What is claimed is:

1. A child-resistant package comprising a container having an exterior thread means, said container including an annular bead spaced below the thread means, an inner cap member having a top panel integrally formed with a depending skirt portion, said depending skirt portion having thread means formed on the interior surface thereof for engagement with the thread means on the container, an outer member having a peripheral skirt portion surrounding the skirt portion of the inner cap member, interengaging means between said inner cap member and said outer closure member operable upon relative axial movement between said members to interengage said members such that rotation of said outer member will also rotate said inner member to disengage the thread means of said inner member from the thread means of a container, and a tamper-indicating member comprising an annular ring having portions extending between the lower edge of the skirt portion of the outer closure member and a portion of the container and operable to normally prevent axial movement of the outer closure member.

2. The child-resistant package set forth in claim 1 wherein said tamper-indicating member is mounted on one of said inner cap member or outer closure member.

3. The child-resistant package set forth in claim 1 wherein said tamper-indicating member is mounted on the outer closure member.

4. The child-resistant package set forth in claim 1 wherein said ring of said tamper-indicating member surrounds said skirt portion of said outer closure member.

5. The child-resistant package set forth in claim 4 wherein said radially extending portions extend from the lower edge of said ring.

6. The child-resistant package set forth in claim 5 wherein said radial portions are circumferentially spaced.

7. The child-resistant package set forth in claim 6 wherein said radial portions are equally spaced.

8. The child-resistant package set forth in claim 1 wherein said ring includes an annular bead, said skirt portion of said outer closure member including an annular rib for retaining said ring on said skirt portion.

9. The child-resistant package set forth in claim 8 wherein the lower end of the skirt portion of the outer closure member normally engages the radial portions of said ring when said ring is in position on said closure member.

10. The child-resistant package set forth in claim 1 wherein said tamper-indicating ring includes a weakened line to facilitate removal.

11. The child-resistant package set forth in claim 10 wherein said tamper-indicating ring includes a tab for grasping the ring to facilitate removal.

12. The child-resistant package set forth in claim 11 wherein said tab extends radially.

13. The child-resistant package set forth in claim 11 wherein said tab extends generally tangentially.

14. The child-resistant package set forth in claim 1 including a thin ring joined to the portions extending from the tamper indicating member along weakened portions such that the thin ring remains on the container when the tamper-indicating ring is removed.

15. The child-resistant package set forth in claim 1 wherein said portions extending from said tamper-indicating member comprise a solid ring portion extending between the lower edge of the skirt portion of the outer closure member and a portion of the container and operable to normally prevent axial movement of the outer closure member.

16. The child-resistant package set forth in claim 1 wherein said tamper-indicating member comprises a ring underlying said skirt portion of said outer closure.

17. A child-resistant closure for containers having an exteriorly threaded finish portion comprising an inner cap member having a top panel integrally formed with a depending skirt portion, said depending skirt portion having thread means formed on the interior surface thereof for engagement with the finish portion of the container, an outer member having a peripheral skirt portion surrounding the skirt portion of the inner cap member, interengaging means between said inner cap member and said outer closure member operable upon relative axial movement between said members to interengage said members such that rotation of said outer member will also rotate said inner member to disengage the thread means of said inner member from the thread means of a container, and a tamper-indicating member comprising an annular ring having portions extending between the lower edge of the skirt portion of the outer closure member and a portion of the container and operable to normally prevent axial movement of the outer closure member.

18. The child-resistant closure set forth in claim 17 wherein said tamper-indicating member is mounted on one of said inner cap member or outer closure member.

19. The child-resistant closure set forth in claim 17 wherein said tamper-indicating member is mounted on the outer closure member.

20. The child-resistant closure set forth in claim 17 wherein said ring of said tamper-indicating member surrounds said skirt portion of said outer closure member.

21. The child-resistant closure set forth in claim 17 wherein said radially extending portions extend from the lower edge of said ring.

22. The child-resistant closure set forth in claim 21 wherein said radial portions are circumferentially spaced.

23. The child-resistant closure set forth in claim 22 wherein said radial portions are equally spaced.

24. The child-resistant closure set forth in claim 17 wherein said ring includes an annular bead, said skirt portion of said outer closure member includes an annular rib for retaining said ring on said skirt portion.

25. The child-resistant closure set forth in claim 24 wherein the lower end of the skirt portion of the outer closure member normally engages the radial portions of said ring when said ring is in position on said closure member.

26. The child-resistant closure set forth in claim 17 wherein said tamper-indicating ring includes a weakened line to facilitate removal.

27. The child-resistant closure set forth in claim 26 wherein said tamper-indicating ring includes a tab for grasping the ring to facilitate removal.

28. The child-resistant package set forth in claim 27 wherein said tab extends radially.

29. The child-resistant package set forth in claim 27 wherein said tab extends generally tangentially.

30. The child-resistant package set forth in claim 17 including a thin ring joined to the portions extending from tamper indicating member along weakened portions such that the thin ring remains on the container when the tamper-indicating ring is removed.

31. The child-resistant package set forth in claim 17 wherein said portions extending from said tamper-indicating member comprise a solid ring portion extending between the lower edge of the skirt portion of the outer closure member and a portion of the container and operable to normally prevent axial movement of the outer closure member.

32. The child-resistant package set forth in claim 17 wherein said tamper-indicating member comprises a ring underlying said skirt portion of said outer closure.

* * * * *

UNITED STATES PATENT OFFICE
CERTIFICATE OF CORRECTION

PATENT NO. : 4,454,955

DATED : June 19,1984

INVENTOR(S) : M. Kusz and W. E. Fillmore

It is certified that error appears in the above-identified patent and that said Letters Patent are hereby corrected as shown below:

Col. 3, line 41, delete "present" and insert therefor --prevent--.
Col. 3, line 42, delete "tthe" and insert therefor --the--.

Signed and Sealed this

*Thirtieth* Day of *October 1984*

[SEAL]

*Attest:*

GERALD J. MOSSINGHOFF

*Attesting Officer*

*Commissioner of Patents and Trademarks*